350-319 SR
12/27/77 XR 4,065,059

United States Patent [19]

Jablin

[11] 4,065,059

[45] Dec. 27, 1977

[54] REPAIR GUN FOR COKE OVENS

[76] Inventor: Richard Jablin, P.O. Box 514, Winchester, Va. 22601

[21] Appl. No.: 721,095

[22] Filed: Sept. 7, 1976

[51] Int. Cl.[2] ..... B05B 13/06; B05C 7/02

[52] U.S. Cl. ..... 239/184; 239/128; 356/241; 350/319

[58] Field of Search ..... 239/128, 184, 186, 187, 239/289; 118/306, 323; 356/241; 350/63, 319

[56] References Cited

U.S. PATENT DOCUMENTS

| | | | |
|---|---|---|---|
| 954,241 | 4/1910 | Affelder et al. | 239/187 |
| 1,775,452 | 9/1930 | Fischer | 356/241 |
| 2,959,090 | 11/1960 | Davies | 350/63 |
| 3,382,757 | 5/1968 | Poirrier | 356/241 |
| 3,552,821 | 1/1971 | Cross | 350/63 |
| 3,957,203 | 5/1976 | Bullard | 239/187 |

*Primary Examiner*—Robert W. Saifer

[57] ABSTRACT

A gun for repairing the refractory walls of a coke oven comprising an air-cooled, pressurized, insulated tube which contains an internal pipe for conveying refractory repair material. The tube is mounted in a support at one end, so arranged that the tube can be rotated about its axis and tilted. The other end of the tube has a nozzle for spraying the refractory repair material at right angles to the axis of the tube. The operator is stationed at the support end and can observe the deposition of repair material by looking through a telescope at the support end which is directed to an angled mirror and open sight port at the other end. Air is blown through the tube to keep it cool and out of the sight port at high velocity in order to prevent the refractory repair material from entering the port and coating the mirror.

6 Claims, 5 Drawing Figures

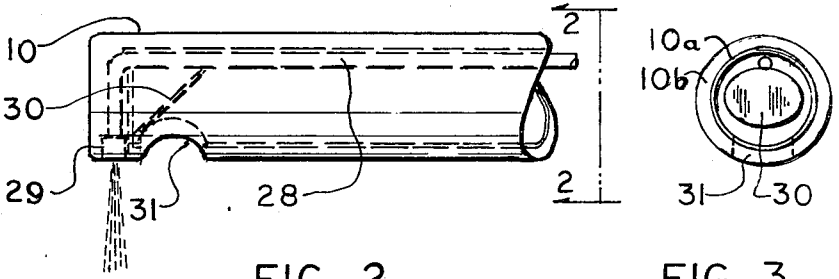
FIG. 3
FIG. 2
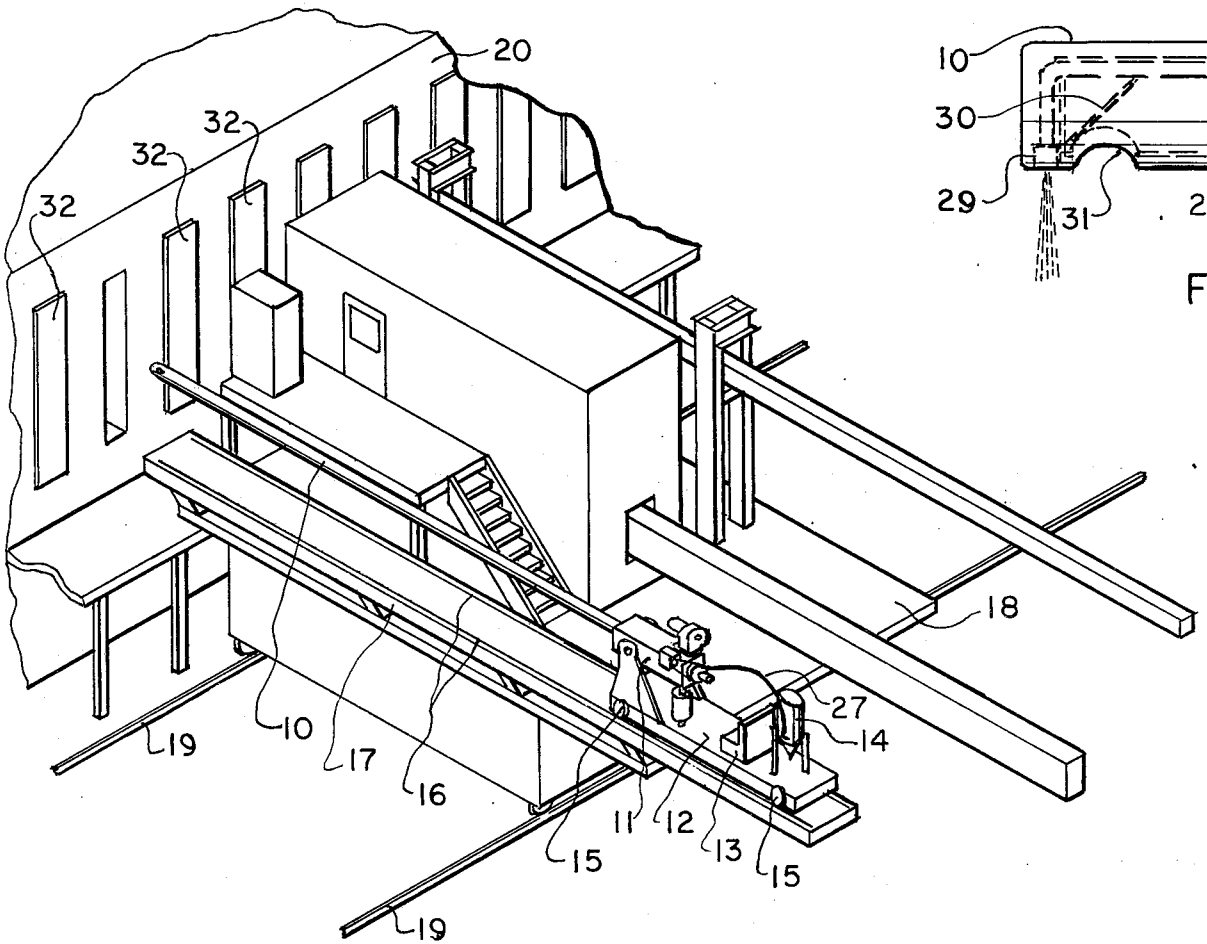
FIG. 1

REPAIR GUN FOR COKE OVENS

DISCLOSURE OF INVENTION

The present invention relates to a gun for repairing the refractory walls of coke ovens. As a battery of coke oven ages, cracks appear in the refractory walls. These cracks are difficult to repair for two reasons. One is that the ovens may not be cooled below red heat over the life of the battery which may be 25 years or more. In consequence, repairs must be made to the walls while they are hot. The other is that the ovens are long and narrow making access to the cracks and observation of the repairs extremely difficult and often impossible. Typical dimensions of the ovens are 40 to 50 feet long and 18 inches wide.

At present, there are two methods for repairing cracks in coke ovens. One is to use a hand-held gun which is of small size an of limited length. The man holds the gun, stands in the opening of the hot oven and repairs whatever cracks he can see and reach. Adverse working conditions make his job difficult and result in unsatisfactory repairs.

The other method is to seal the oven to be repaired from the rest of the ovens in the battery and to blow silica dust into it. The dust finds its way out of the cracks which, if they are small enough, may become sealed. Large cracks cannot be sealed in this manner. Further, there is a carry over of dust into the flues and regenerators which is harmful.

During the coking cycle, a coke oven is maintained at a pressure which is slightly above atmosphere. The purpose is to prevent an infiltration of air to the coal while it is being coked. During the coking cycle, fuel gases are evolved from the coal. If there are cracks in the walls of the oven, the gases seep through these cracks into the flues. This causes a loss of valuable fuel gas. In addition, because the flues are hot and contain inert gases, the fuel gas carbonizes and leaves the stack as smoke, causing air pollution.

A purpose of this invention is to provide an improved repair gun for sealing cracks in the refractory walls of the coke oven.

A further purpose of this invention is to place the operator of the repair gun in comfortable surroundings which are away from the heat of the oven and, at the same time, permit him to closely observe the filling of the crack and to accurately direct the spray of repair material into the crack.

A further purpose of this invention is to mount the repair gun in a substantial housing and to provide power-operated mechanisms such that the spray of repair material may be directed into the crack with little effort on the part of the operator and with a reasonable degree of precision.

In the drawings, I have chosen to illustrate one of the several embodiments in which the invention may appear, selecting the forms shown from the standpoints of convenience in illustration, satisfactory operation and clear demonstration of the principles involved.

FIG. 1 is an isometric drawing of the repair gun which is mounted on the pusher machine of the battery coke ovens.

FIG. 2 is an enlarged detail of that end of the repair gun which is nearer to the coke ovens.

FIG. 3 is a view on line 2—2 of FIG. 2.

Figure 5:
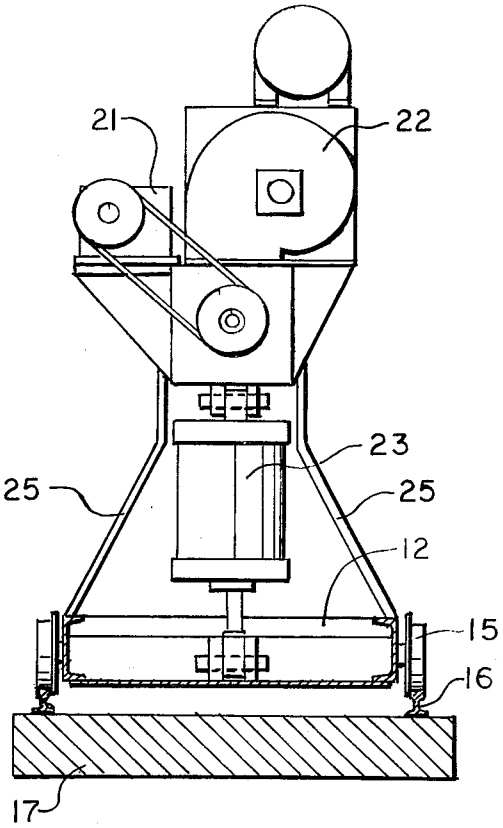
FIG. 5 is a view on line 5—5 of FIG. 4.

In prior art, as previously discussed, repair guns for coke ovens are small, hand-held pipes. No mechanisms are involved. The operator of the gun must work in close proximity of the opening of the oven which, because it is a red heat, subjects him to extreme discomfort. He can observe and reach only those cracks which are near to the open end. These he can repair, buy because of the manual effort and the physical discomfort, he cannot do a fully satisfactory job. The cracks in the middle of the oven he can neither see or reach with the gun. These cracks remain unrepaired.

I have discovered that it is possible to mount the pipe which conveys the refractory repair material internally to a larger tube which is long enough to reach the entire oven. The larger tube is then mounted in a support which has power operated advance, tilt and rotation for positioning the tube and directing the spray of repair material. A telescope mounted at one end of the tube which is directed to an angled mirror at the other end of the tube permits the operator to sight down the tube and closely observe the placement of the refractory repair material in the crack of the oven wall.

In accordance with the invention, the end of the repair gun is moved in front of an opened coke oven from which the coke has been removed. The end of the gun is then moved into the oven.

The operator of the repair gun is seated so that he can look through the telescope down the tube and, at the same time, manipulate the tube by means of controls at his hands. The line of sight of the operator and the spray nozzle for the repair material are both directed to essentially the same location on the wall of the oven. Thus, when he observes a crack in the oven, he may turn on the sprays of repair material with the assurance that the material will be directed into the crack. He can also readily observe the nature of the repair.

First considering FIG. 1, the repair gun consists of a sight tube 10 which is mounted in support 11, which, in turn, is mounted on trolley 12. Also mounted on said trolley is a chair 13 for the operator and a tank 14 for containing the refractory repair material. Said trolley travels by means of wheels 15 on tracks 16 which are laid on bridge 17.

The bridge 17 is supported on the coke pusher machine 18 which runs on tracks 19 in front of the coke oven battery 20. All by-product coke oven batteries are equipped with coke pushers which provides a convenient location for mounting the bridge 17.

Figure 4:
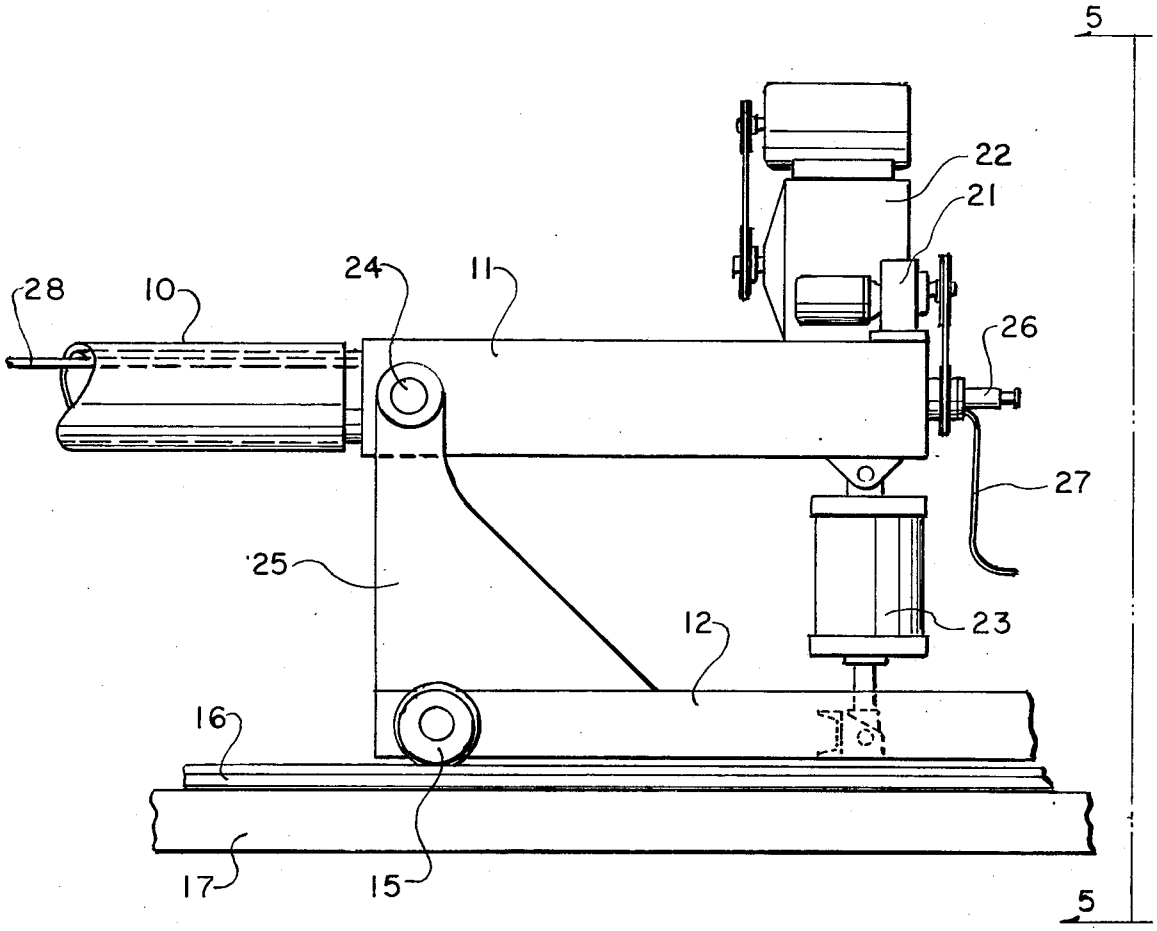
FIG. 4 is an enlarged detail of the support end of the repair gun.

FIGS. 4 and 5 show the detail of the support end of the sight tube 10. Said tube is mounted in bearings within the support 11 and can be rotated within said support by means of a motor-driven reduction gear 21. A pressurizing fan 22 supplies cooling air to said support from whence said air is delivered to sight tube 10 by means of openings in the walls of said tube. A tilt cylinder 23 can tilt said support and its sight tube about trunnion 24 which is mounted on trolley 12 by means of brackets 25.

A telescope 26 is mounted in the end of the sight tube 10 and its line of sight is directed down said tube. Also mounted in the end of said tube is a hose 27 for conveying repair material from the tank 14 to the supply pipe 28. Said tank is equipped with the usual valves and pressurizing devices so that the flow of repair material may be caused to run or cease at the will of the operator.

FIGS. 2 and 3 show the detail of the end of the sight tube 10. Said tube has an inner structural pipe 10*a* and a covering of thermal insulation 10*b*. The supply pipe 28 terminates in a spray nozzle 29 which directs the refractory repair material at right angles to the axis of said tube as shown. An angled mirror 30 directs the line of sight of the telescope 26 through an opening 31 in the side of said tube such that the line of sight essentially follows the path of said spray.

The air from the pressurizing fan 22 flows through the center of sight tube 10 cooling said tube from the radiant heat of the oven walls. Said air flows out through opening 31 at high velocity thereby preventing particles of the refractory repair material from entering said tube and thereby avoiding a coating of refractory material upon the mirror 30 which would otherwise cloud said mirror and interfere with clear vision to the crack.

The operation of the repair gun is as follows: The operator of the pusher machine 18, moves said machine so that the sight tube 10 is located at the centerline of the oven which is to be repaired. As seen in FIG. 1, the oven door 32 has been removed. The operator of the repair gun, seated in chair 13, manipulates controls so as to advance trolley 12 toward the oven. When the end of sight tube 10 is in the oven, he manipulates said tube by means of tilt cylinder 23 and reduction gear 21. When, by means of telescope 26, he observes a crack in the wall of the oven, he activates the spray of refractory material, thereby sealing the crack.

Figure 6:
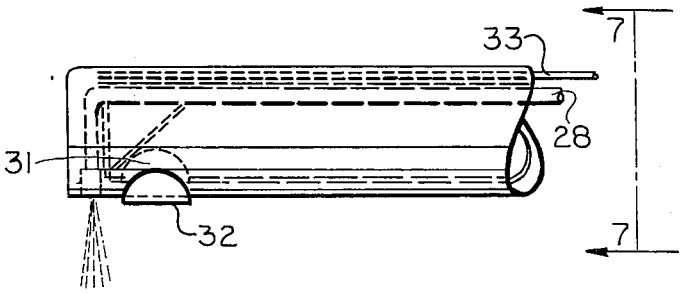
FIG. 6 is an enlarged detail of that end of the repair gun which is nearer to the coke ovens and which embodies a sight glass and water cooling.
Figure 7:
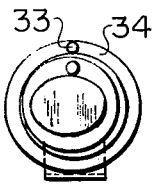
FIG. 7 is a view on line 7—7 of FIG. 6.

The purpose of the invention may be served by various alternatives to those described and illustrated. For example, the sight tube 10 may be cooled by water instead of air and the mirror 30 may be protected by a glass over opening 31, thereby eliminating need for the pressurizing fan 22. FIGS. 6 and 7 show slight glass 32 mounted over opening 31 as well as water supply pipe 33 for supplying cooling water to the end of the annular space 34 around sight tube 10. Said cooling water flows in said annular space from said water supply pipe toward the support end of said sight tube where said cooling water is discharged.

Figure 8:
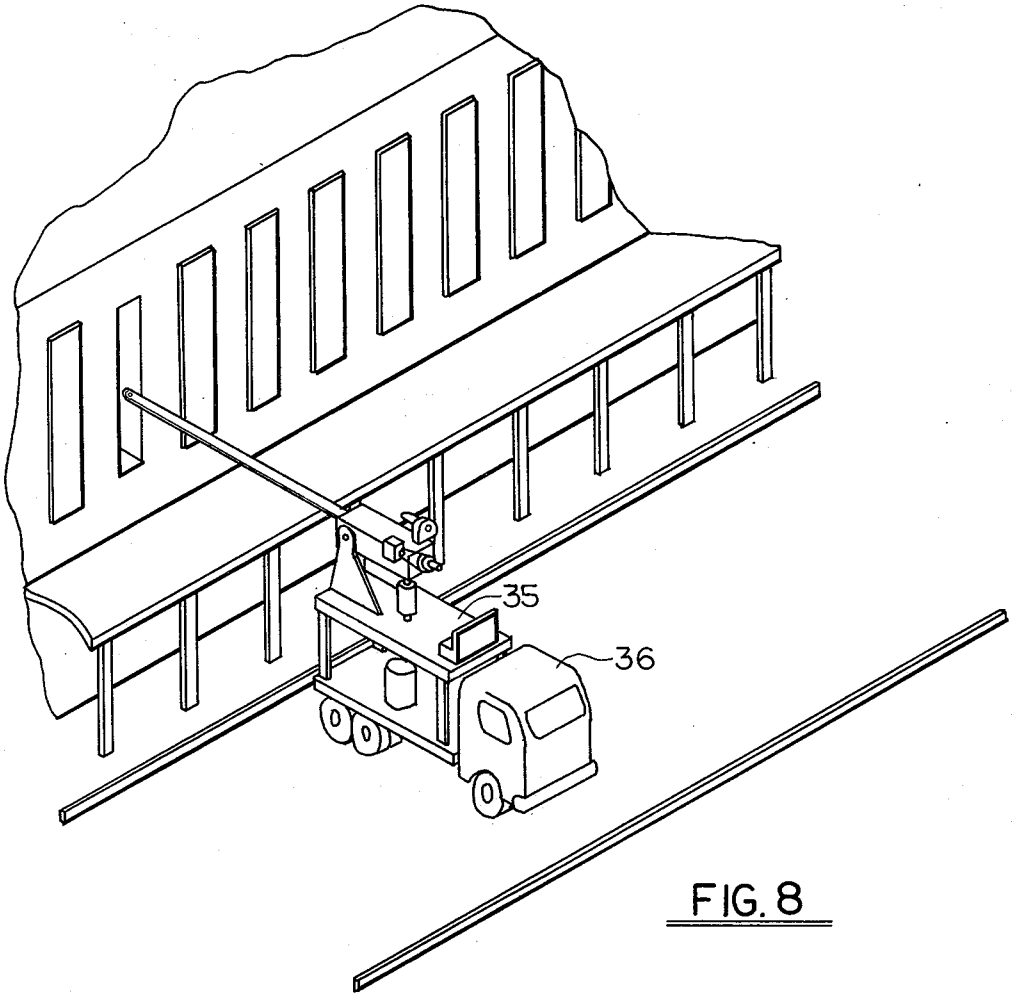
FIG. 8 is an isometric drawing of the repair gun which is mounted on a mobile vehicle.

Additionally, a second set of tank, hose and pipe may be provided in parallel with tank 14, hose 27 and pipe 28, the second set being used to deliver water to a mixer located within said sight tube which, in a conventional manner, mixes said water with the refractory repair material and delivers said mixture to spray nozzle 29. Additionally, the bridge 17 may be carried separately from the pusher machine 18, either by means of a gantry-like structure riding on tracks 19 or by means of a mobile vehicle which is supported by rubber tires, tractor treads etc. FIG. 8 shows platform 35 mounted on a mobile vehicle 36. Said platform and mobile vehicle are equipped with controls for manipulating the sight tube 10 and applying the spray of refractory material as desired. The latter alternative would have the advantage that it could approach the oven from both ends, thereby substantially reducing the required length of the sight tube 10 and eliminating the need for the trolley 12.

In view of my invention and disclosure, variations and modifications to meet individual whim or particular need will doubtless become evident to others skilled in the art, to obtain all or part of the benefits of my invention without copying the apparatus shown and I therefore claim all such insofar as they fall within the reasonable spirit and scope of my claims.

Having thus described my invention, what I claim as new and desire to secure by Letters Patent is:

1. A repair gun for spraying repair material into cracks in the walls of a coke oven comprising:

a. A sight tube which is supported at one end by a structure which has power-assisted devices to permit an operator to tilt and rotate said sight tube.

b. A pipe internal to and axially aligned with said sight tube and terminating in a nozzle at the end of said tube such that refractory repair material may be sprayed through said pipe and nozzle into cracks of the oven walls.

c. A tank for containing the refractory repair material, said tank being equipped for delivering said material through a hose to said internal pipe.

d. A telescope mounted on the operator-end of said sight tube and directed axially along said tube to an angled mirror and through a sight port at the end of said tube such that the operator can observe the deposition of repair material into the cracks of the oven walls.

e. A fan for blowing air through said sight tube to cool said tube, said air leaving at high velocity through said sight port such that particles of refractory repair material are prevented from entering said sight port and clouding said mirror.

f. A power-operated trolley upon which said sight tube, said tank and an operator's control station are mounted such that said trolley may be moved to or away from said oven and said operator may control all motions of said tube and the flow of refractory repair material and, at the same time, observe through said telescope.

g. A bridge with rails for supporting said trolley.

2. A repair gun of claim 1 in which the bridge is mounted on the pusher machine of the coke oven.

3. A repair gun of claim 1 in which the bridge is mounted on a gantry which rides along the battery of coke ovens on rails parallel to said battery.

4. a repair gun of claim 1 in which there are two pipes internal to and axially aligned with the sight tube, a hose for connecting one pipe to a tank containing refractory material, a second hose for connecting the second pipe to a tank of water, a mixer at the end of each of the two pipes which combines said water and said refractory material, and a nozzle for delivering said mixture into cracks of the oven walls.

5. A repair gun for spraying repair material into cracks in the walls of a coke oven comprising:

a. a sight tube which is supported at one end by a structure which has power-assisted devices to permit an operator to tilt and rotate said sight tube;

b. a pipe internal to and axially aligned with said sight tube and terminating in a nozzle at the end of said tube such that refractory repair material may be sprayed through said pipe and nozzle into cracks of the oven walls;

c. a tank for containing the refractory repair material, said tank being equipped for delivering said material through a hose to said internal pipe;

d. a telescope mounted on the operator-end of said sight tube and directed axially along said tube to an angled mirror and through a sight port at the end of said tube such that the operator can observe the deposition of repair material into the cracks of the oven walls;

e. an annular space concentric to and external to said sight tube and a supply of cooling water to said annular space so arranged that said cooling water flows through said annular space and protects said sight tube from the heat of the coke oven; and f. a sight glass covering the opening of said sight port such that particles of refractory repair material are prevented from entering said opening and clouding said mirror.

6. A repair gun for spraying repair material into cracks in the walls of a coke oven comprising:

a. a sight tube which is supported at one end by a structure which has power-assisted devices to permit an operator to tilt and rotate said sight tube;

b. a pipe internal to and axially aligned with said sight tube and terminating in a nozzle at the end of said tube such that refractory repair material may be sprayed through said pipe and nozzle into cracks of the oven walls;

c. a tank for containing the refractory repair material, said tank being equipped for delivering said material through a hose to said internal pipe;

d. a telescope mounted on the operator-end of said sight tube and directed axially along said tube to an angled mirror and through a sight port at the end of said tube such that the operator can observe the desposition of repair material into the cracks of the oven walls e. a fan for blowing air through said sight tube to cool said tube, said air leaving at high velocity through said sight port such that particles or refractory repair material are prevented from entering said sight port and clouding said mirror; and f. a mobile vehicle upon which said sight tube, said tank and an operator's control station are mounted such that said sight tube may be moved into said oven and said operator may control all motions of said sight tube and the flow of refractory repair material and, at the same time, observe through said telescope.

* * * * *

UNITED STATES PATENT OFFICE

CERTIFICATE OF CORRECTION

Patent No. 4,065,059 Dated December 27, 1977

Inventor(s) Richard Jablin

It is certified that error appears in the above-identified patent and that said Letters Patent are hereby corrected as shown below:

Disclosure, column 2, line 14, change "buy" to --but--.

Disclosure, column 3, line 41, change "slight" to --sight--.

Signed and Sealed this

Twenty-fifth Day of April 1978

[SEAL]

Attest:

RUTH C. MASON
Attesting Officer

LUTRELLE F. PARKER
Acting Commissioner of Patents and Trademarks